United States Patent [19]

Vine

[11] 4,305,605

[45] Dec. 15, 1981

[54] SOFT COVER FOR BOOK AND METHOD FOR MAKING SAME

[76] Inventor: Joseph Vine, 27 E. 65th St., New York, N.Y. 10021

[21] Appl. No.: 137,951

[22] Filed: Apr. 7, 1980

[51] Int. Cl.[3] ..... B42D 3/00; G09F 1/00

[52] U.S. Cl. ..... 281/35; 283/56; 11/2; 11/3

[58] Field of Search ..... 281/17, 19 R, 29, 34, 281/35; 11/2, 3; 283/56, 63 R, 64, 66 A, 65

[56] References Cited

U.S. PATENT DOCUMENTS

| | | | |
|---|---|---|---|
| 1,495,831 | 5/1924 | Abel | 283/56 |
| 1,754,811 | 4/1930 | Webb | 281/34 |
| 2,309,244 | 1/1943 | Fey | 283/63 R X |
| 3,520,560 | 7/1970 | Isaac | 283/56 |
| 3,582,111 | 6/1971 | Siiter | 283/56 |
| 3,858,792 | 1/1975 | Volkert | 283/56 X |

*Primary Examiner*—Paul A. Bell
*Assistant Examiner*—John S. Brown
*Attorney, Agent, or Firm*—Eric P. Schellin

[57] ABSTRACT

A soft cover and coupon insert for paperback books and a method for making the same is disclosed, where the cover and coupon insert are printed on both sides of a blank sheet of material. The printed sheet is folded in half on a terminal end fold line and bonded together on spine receiving portions, which separate the front and back portions of the cover and coupon insert. The front cover portion is separated from the front coupon insert portion by severing along a cut line positioned a sufficient distance from the terminal end fold line.

14 Claims, 7 Drawing Figures

SOFT COVER FOR BOOK AND METHOD FOR MAKING SAME

BACKGROUND OF THE INVENTION

It is a common practice in connection with merchandising of paperback books for the distributor to credit the retailer for unsold copies. To receive credit the retailer removes the outer cover and returns it to the distributor. This reduces the handling and shipping cost of entire books. However, it is also a common practice to provide printed advertising inserts bound into sections of a book, or inserted loose between the pages. Occasionally these advertising inserts include coupons which are used as promotional aids to sell subscriptions to book clubs, and other products. Normally, publishers have not provided control for redemption of these coupons because the advertising insets are often inserted in different places in the page sections which would require a lot of time searching through the various publications to retrieve the coupon inserts to return them with the covers.

Heretofore, paperback books have had front and back covers made from a heavy grade paper stock folded in half and glued to the center fold of the book insert, or front and back covers are made of a lesser grade paper folded in multiple plies which are then glued together at their interfaces and stapled or glued to the center fold of the book insert. In the latter construction, the widths of the inner plies of the cover are either folded one-fourth of the total width of the cover sheet or blank to provide a double ply spine receiving areas for stapling or gluing to the book insert, or the width of the inner plies are folded less than the total width of the cover sheet or blank to provide a single ply spine receiving area for stapling or gluing to the book insert. In each of these cases the finished cover had ends which by reason of the folding operations are rounded to avoid the so-called "raw" edges so many times associated with cutting or other severing operations.

It has been suggested in U.S. Pat. No. 2,132,341, to provide a multiple ply cover with an integral fly leaf for each or both of the front and back cover portions by providing sufficient additional width of cover sheet material. In the same patent it is also suggested that they fly leaves could also be printed, if desired.

A search of the prior art patents on book covers and coupon inserts developed the following list of patents:

U.S. Pat. No. Re. 26,049
U.S. Pat. No. 1,495,831
U.S. Pat. No. 2,132,341
U.S. Pat. No. 2,185,392
U.S. Pat. No. 2,309,244
U.S. Pat. No. 3,520,560
U.S. Pat. No. 3,582,111
U.S. Pat. No. 3,858,792.

SUMMARY OF THE INVENTION

The present invention is directed to an improved soft book cover and a method for making the same, and, in particular, to a soft book cover and insert coupon sheet and the method for making the same from a single printed sheet.

Pursuant to the method of the present invention, the paper stock, while in web form, is impressed upon on one or both faces with printed matter. The stock is cut to provide a single cover sheet with a single coupon insert sheet joined together by a fold line. Each cover and coupon insert sheet is folded in such a manner that the printed outsides of the cover are exposed. A second fold is made along the receiving spine area which has been defined on the coupon insert sheet. The resulting superimposed cover and coupon insert are secured to the book insert by an adhesive or some other fastening means. After the book insert is inserted, the front edges of the cover sheet, coupon insert sheet, and the book insert are severed to separate the cover sheet from the coupon insert sheet, and to trim the ragged edges of the book insert.

The invention is of special utility to enable the cover sheet and coupon insert sheet to be removed from book copies which have not been sold. In addition, the invention simplifies the method of positioning coupon inserts in book inserts and forming a combined cover sheet and coupon insert sheet by using a single printing step and two folding steps. The method of the present invention also reduces the cost of making soft covers and coupon inserts.

A characteristic of soft covers and coupon inserts, pursuant to the present invention, resides in the fact that the front or terminal ends between the cover and coupon insert are severed after the book insert is installed. This is a feature not used heretofore in cover making.

The coupon insert sheet may have detachable portions surrounded by perforations marks for easy separation of the coupons printed thereon.

Various objects and features of the invention will be apparent from a consideration of the accompanying specification, claims and drawings.

DESCRIPTION OF THE INVENTION

Figure 1:
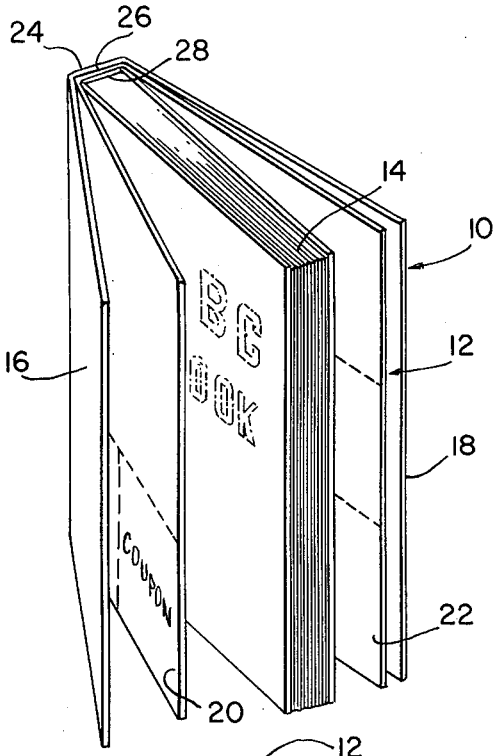
FIG. 1 is a perspective view of a book insert showing a cover sheet and a coupon insert sheet in accordance with the present invention.

Referring to the drawings there is shown in FIG. 1 a typical soft cover 10 and a coupon insert sheet 12, in accordance with the invention, and a book insert 14. The cover 10 includes a front portion 16 and a back portion 18, and the coupon insert sheet 12 includes a similarly situated front portion 20 and a back portion 22. As will be discussed, the cover 10 and the coupon insert sheet 12 have printed matter on their outside and inside faces. Defined as a separation between the front and back portions of the cover 10 and the coupon insert sheet 12 are spine receiving portions 24 and 26, respectively, for fastening the cover 10 and coupon insert sheet 12 to spine receiving portion 28 of the book insert 14. Adhesive or some other fastening means is used to fasten the cover spine receiving portion 24 and coupon insert sheet spine receiving portion 26 to book insert spine portion 28.

Figure 5:
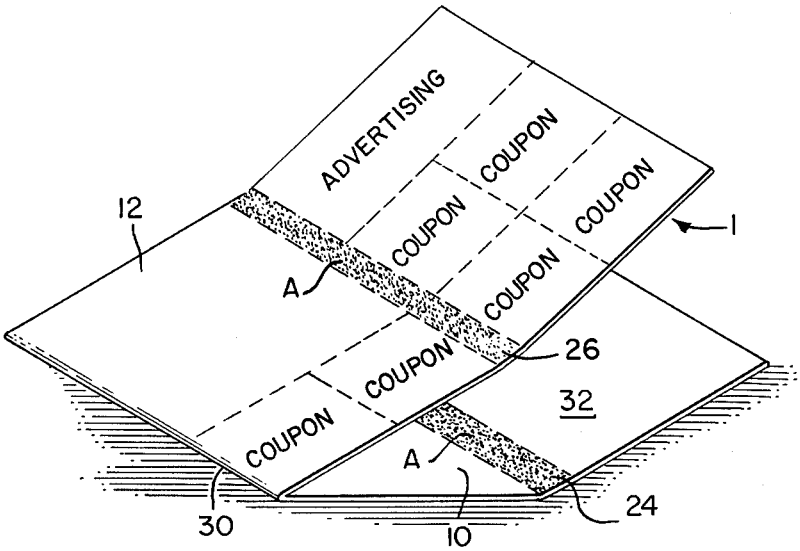
FIG. 5 is a perspective view of a partially folded cover and coupon insert sheet in accordance with the present invention.
Figure 6:
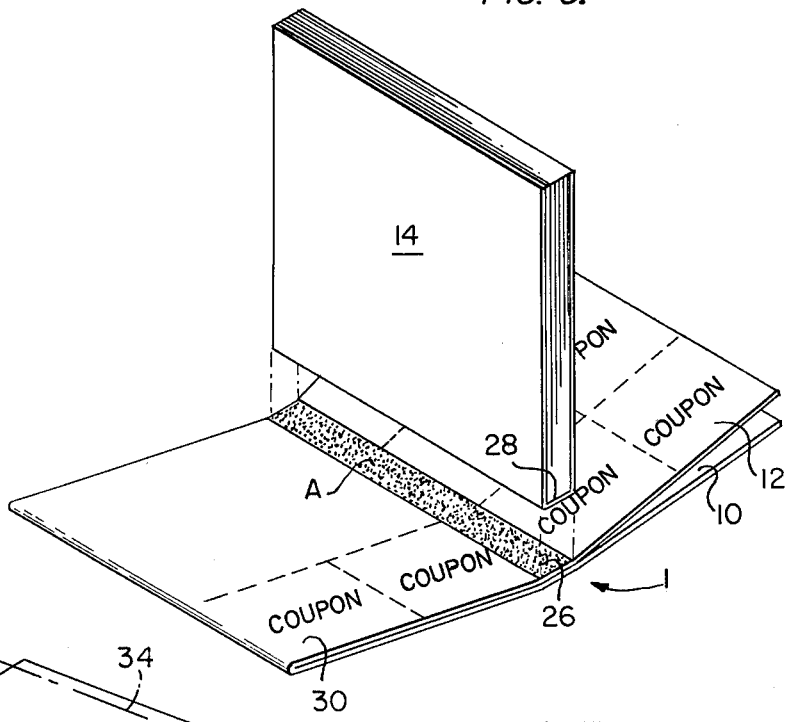
FIG. 6 is a perspective view of a cover and coupon insert sheet in accordance with the present invention showing a method of inserting a book insert.

A combined cover and coupon insert blank 1 is shown in FIG. 5 folded along a terminal end 30, between the cover 10 and the coupon insert sheet 12. Adhesive A has been applied to the spine portion 24 on the inside 32 of the cover 10 to adhere the spine receiving portion 26 of the coupon insert sheet to the cover spine receiving portion 24. Adhesive A has also been applied either to the coupon insert sheet spine receiving portion 26 or to the book spine to fasten a book insert 14 to the combined cover and coupon insert blank 1, as shown in FIG. 6. It is understood that the cover 10 is now fastened to the coupon insert sheet 12 at the spine receiving portions 24 and 26, respectively, and at the terminal end 30. Care has been taken not to adhere the interfaces between inside cover face and the adjacent coupon insert sheet face to one another.

Figure 7:
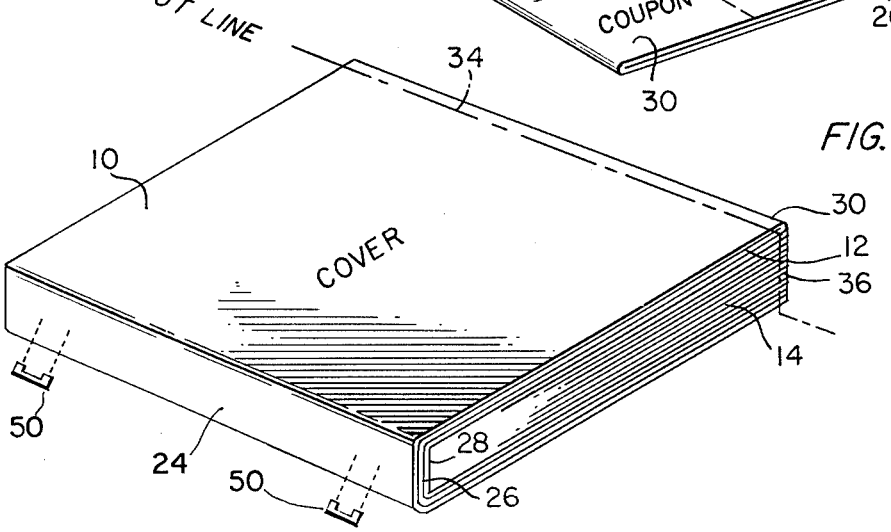
FIG. 7 is a perspective view of a cover and coupon insert sheet in accordance with the present invention prior to a trimming step.

The cover 10 is severed from the coupon insert sheet 12 just inside the terminal end 30 after the book insert 14 has been adhered to the spine receiving portion 26 of the coupon insert sheet. The cut line 34 for severing the cover 10 from the coupon insert sheet 12 is best shown in FIG. 7. In severing along cut line 34, the ragged edges 36 of the book insert 14 are also severed, leaving a uniform front edge on the magazine.

Figure 3:
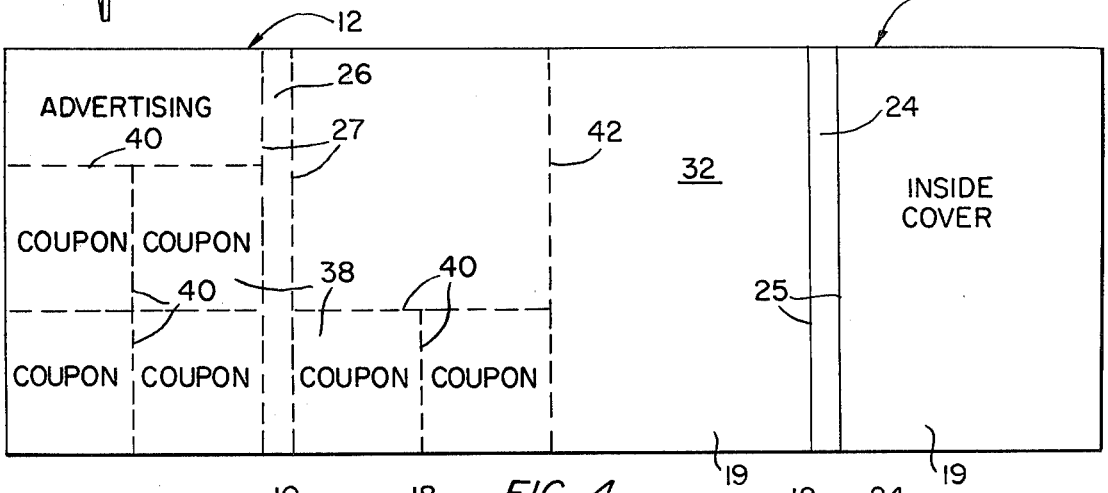
FIG. 3 is a plan view of an inside of a cover sheet and coupon insert sheet printed in accordance with the present invention.
Figure 4:
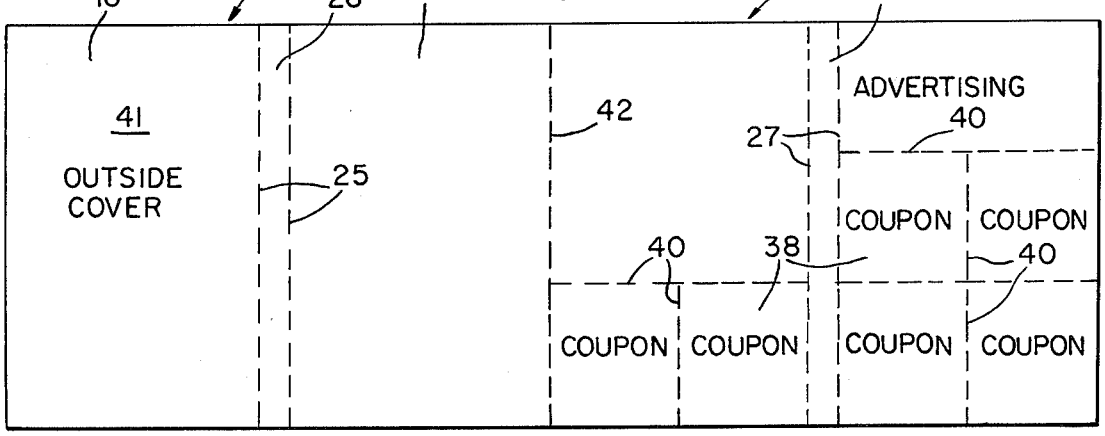
FIG. 4 is a plan view of an outside of a cover sheet and coupon insert sheet printed in accordance with the present invention.

Referring again to the printed matter FIGS. 3 and 4 show both sides of a combined cover and coupon insert blank 1. Illustrative of the type of printed matter which could be on the coupon insert sheet 12, there may be printed thereon a plurality of coupons 38 with printed notations designating the value of the coupon and the article for which is can be redeemed for a cash discount. Each coupon 38 would be defined by a detachable portion with perforations 40 surrounding the coupon. Thus, by starting at an outside edge a coupon 38 is readily removed by tearing along perforations 40.

The coupon insert sheet 12 preferably has on it additional information, such as the name of the product, its manufacturer, and statements with regard to advertisement of the product, and the manner in which the coupons are to be used.

Figure 2:
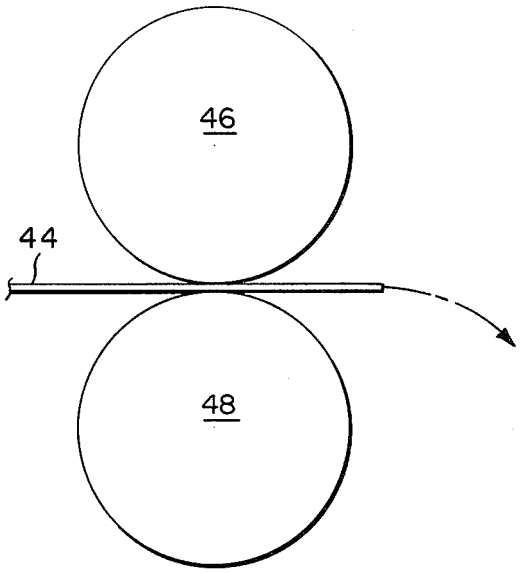
FIG. 2 is a side view of a printing impression step for forming a cover sheet and a coupon insert sheet in accordance with the present invention.

The outside face 41 of the cover 10 is printed on its front portion 16 with suitable titles and other information pertaining to the book. The outside back cover 18 and the inside cover faces 19 are normally used to advertise contributors' products or services. In printing the combined cover and coupon insert blank 1, the spine receiving portions 24 and 26 are defined by demarcation lines 25 and 27, respectively, and the terminal end fold line 42 is printed to avoid any chance of error during folding. FIG. 2 shows a typical printing method for simultaneously impressing printed matter on both faces of a combined cover and coupon insert sheet by passing a paper web 44 between a pair of printing rolls 46 and 48.

In making a combined cover and coupon insert blank 1, a paper web 44 of suitable quality for book covers, etc. is conveyed between the printing rolls 46 and 48. The printed paper web 44 is then perforated along the detachable portions to provide perforation lines 40. A combined cover and coupon insert blank 1 is severed from the web and folded in half along the line 42 forming the terminal end 30. As stated earlier adhesive is applied to the spine receiving portions 24 and 26 to adhere the coupon insert sheet 12 to the cover 10 along the spine portions. The book insert spine portion 28 is adhesively bonded to the spine receiving portion 26 and the terminal end 30 is severed along cut line 34 to separate the cover 10 from the coupon insert sheet 12. Instead of adhesive, staples 50 may be applied through the spine receiving portions 24 and 26 and the book insert spine portion 28 to secure them to one another.

In case the book is not sold the retailer removes the cover 10 and coupon insert by gripping them together and pulling along the adhesive bond of the spine receiving portions. The cover and coupon insert can then be returned to the distributor for credit.

While only one embodiment of the invention has been described it will be understood that many changes and modifications may be made without departing from the spirit of the invention as defined herein and in the claims that follow.

What is claimed is:

1. The method of producing a soft cover and an advertising coupon insert for paperback books which comprises:

printing on both faces of a blank of sheet material;

folding the printed sheet material along a terminal end fold line to provide a cover portion and a coupon insert portion;

defining first spine receiving portion on said cover portion, and a second spine receiving portion on said coupon insert portion;

securing said coupon insert portion to said cover portion at said second spine receiving portion and said first spine receiving portion;

securing a book insert having a spine portion to said second spine receiving portion, and separating said cover portion from said coupon insert portion along a line located at or close to said terminal end fold line.

2. The method of producing a soft cover and coupon insert for paperback books as claimed in claim 1 wherein said first spine receiving portion and said second spine receiving portion are folded along at least one demarcation fold line to define front and back cover portions and front and back coupon insert portions.

3. The method of producing a soft cover and coupon insert for paperback books as claimed in claim 2 wherein said first spine receiving portion is adhesively bonded to said second spine receiving portion on said at least one demarcation fold line, and adhesively bonding the book insert spine portion to said second spin receiving portion on said at least one demarcation fold line.

4. The method of producing a soft cover and coupon insert for paperbacks as claimed in claim 2 wherein said second spine receiving portion is aligned on said first spine receiving portion and the book insert spine portion is aligned on said second spine receiving portion, and stapling said first spine portion and second spine receiving portion and the book spine portion to one another.

5. The method of producing a soft cover and coupon insert for paperback books as claimed in claim 3 or 4 wherein separating said cover portion from said coupon insert portion along a line located at or close to said terminal end fold line is by cutting on a cut line on said cover portion, said cut line being located a sufficient distance from said terminal end fold line to separate said cover portion from said coupon insert portion and to remove ragged edges from the book insert.

6. A soft cover and coupon insert for paperback books formed by printing on both faces of a blank of sheet material, folding the resulting printed sheet material along a terminal end fold line and securing the folded printed sheet material to a book insert spine portion of a book, and severing the printed sheet material a sufficient distance from said terminal end fold line to provide a separate cover and a separate coupon insert where the coupon insert is secured between the cover and the book insert.

7. A soft cover and coupon insert for paperback books as in claim 6 wherein said resulting printed sheet material includes a first spine receiving portion between front and back cover portions, and a second receiving spine portion between front and back coupon insert portions.

8. A soft cover and coupon insert for paperback books as in claim 7 wherein said first spine receiving portion and said second spine receiving portion are bonded together by an adhesive.

9. A soft cover and coupon insert for paperback books as in claim 7 wherein the book insert spine portion is secured to said second spine receiving portion of the folded printed sheet material.

10. A soft cover and coupon insert for paperback books as in claim 9 wherein said coupon insert includes perforated lines for removing printed coupons from the coupon insert.

11. A soft cover and coupon insert for paperback books as in claim 10 wherein said soft cover and coupon insert are printed on both faces of said blank of sheet material.

12. A method of forming a soft cover and coupon insert for paperback books comprising:

printing on both faces of a blank of sheet material to provide a printed front cover portion and back cover portion separated by a first spine receiving portion, a printed front coupon insert portion and a back insert portion separated by a second receiving spine portion, and a terminal end fold line between said front cover portion and said front coupon insert portion;

folding said resulting printed sheet material in half along said terminal end fold line;

severing said front cover portion from said front coupon insert portion a sufficient distance from said terminal end fold line.

13. A method of forming a soft cover and coupon insert of claim 12 including securing a paperback book having a spine portion to said first and second spine receiving portions.

14. A method of forming a soft cover and coupon insert of claim 13 where the securing of the paperback book to said first spine receiving portion and second spine receiving portion is prior to severing said front cover from said front coupon insert.

* * * * *